United States Patent [19]

Grappendorf

[11] Patent Number: 4,491,188

[45] Date of Patent: Jan. 1, 1985

[54] DIAMOND CUTTING ELEMENT IN A ROTATING BIT

[75] Inventor: Richard H. Grappendorf, Riverton, Utah

[73] Assignee: Norton Christensen, Inc., Salt Lake City, Utah

[21] Appl. No.: 473,020

[22] Filed: Mar. 7, 1983

[51] Int. Cl.[3] ..... E21B 10/46

[52] U.S. Cl. ..... 175/329; 175/330; 175/410

[58] Field of Search ..... 175/329, 330, 410, 374, 175/375, 379; 407/118; 51/209 R, 307-309; 76/108 R, 108 A; 125/20

[56] References Cited

U.S. PATENT DOCUMENTS

| | | | |
|---|---|---|---|
| 3,692,127 | 9/1972 | Hampe et al. | 175/330 |
| 4,190,126 | 2/1980 | Kabashima | 175/330 X |
| 4,207,954 | 6/1980 | Jerome | 175/330 |

FOREIGN PATENT DOCUMENTS

| | | | |
|---|---|---|---|
| 2081347 | 2/1982 | United Kingdom | 175/329 |

OTHER PUBLICATIONS

"Geoset Drill Diamond", General Electric Company, Sep. 1981, (Specialty Materials Dept.).

*Primary Examiner*—Stephen J. Novosad
*Assistant Examiner*—Thuy M. Bui
*Attorney, Agent, or Firm*—Beehler, Pavitt, Siegemund, Jagger & Martella

[57] ABSTRACT

An improved tooth for use in rotating diamond bits incorporating a generally triangular prismatic polycrystalline diamond element is devised by integrally forming an oval shaped base about the tooth or element extending from the face of the rotating bit, thereby providing a lateral reinforcing collar. The diamond element is also reinforced by a tapered trailing support having a leading surface contiguous and substantially congruous with the trailing surface of the diamond element. In one embodiment, a prepad provides reinforcement or support for the leading surface of the diamond element.

15 Claims, 8 Drawing Figures

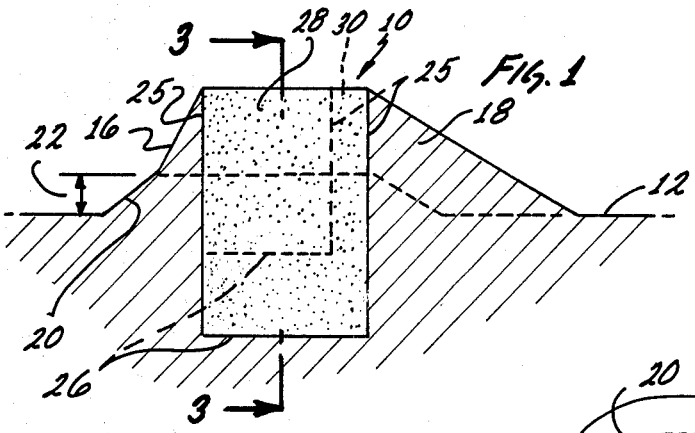
FIG. 1
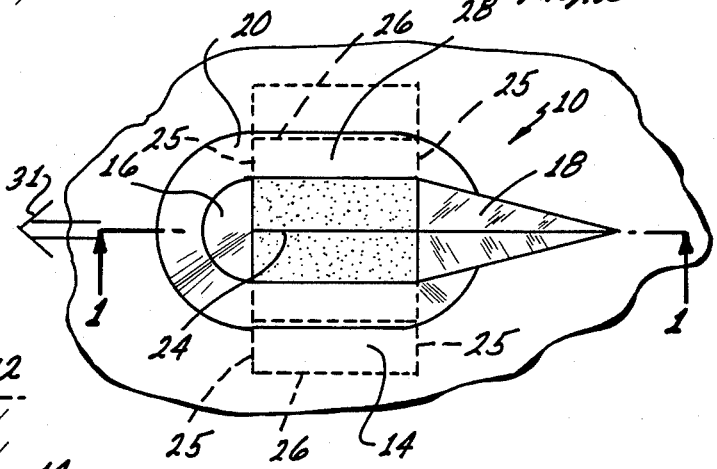
FIG. 2
FIG. 3
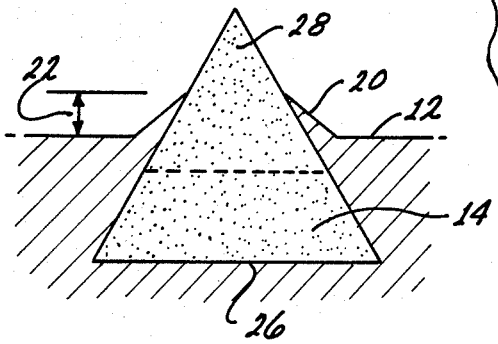
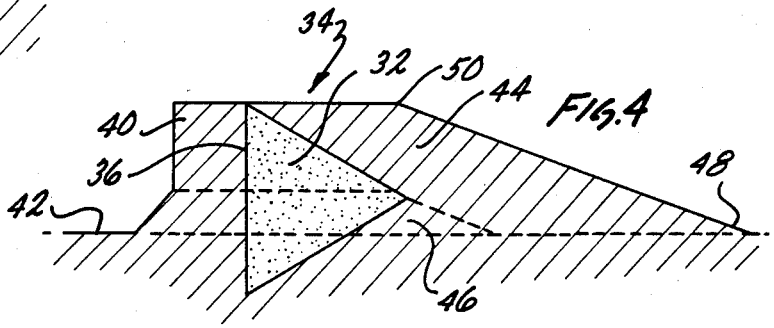
FIG. 4
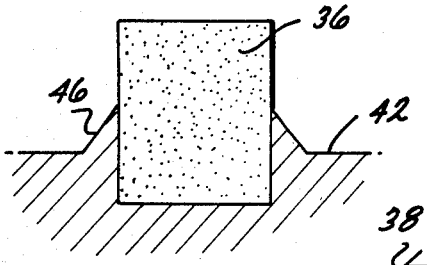
FIG. 6
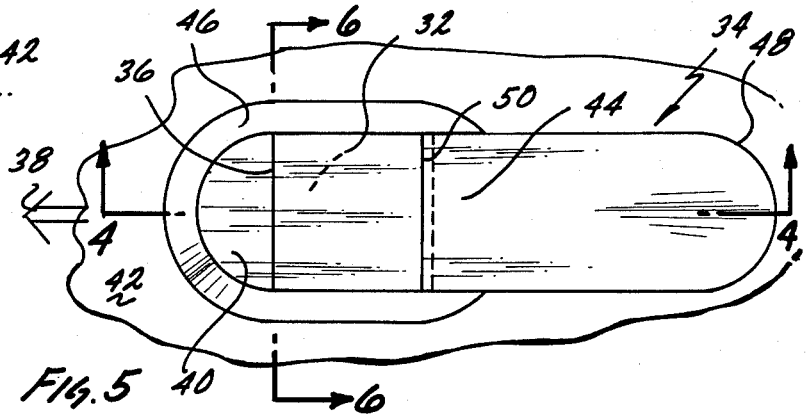
FIG. 5

DIAMOND CUTTING ELEMENT IN A ROTATING BIT

BACKGROUND OF THE INVENTION

1. Field of the Invention

The present invention relates to the field of earth boring tools and in particular to rotating bits incorporating diamond cutting elements.

2. Description of the Prior Art

The use of diamonds in drilling products is well known. More recently synthetic diamonds both single crystal diamonds (SCD) and polycrystalline diamonds (PCD) have become commercially available from various sources and have been used in such products, with recognized advantages. For example, natural diamond bits effect drilling with a plowing action in comparison to crushing in the case of a roller cone bit, whereas synthetic diamonds tend to cut by a shearing action. In the case of rock formations, for example, it is believed that less energy is required to fail the rock in shear than in compression.

More recently, a variety of synthetic diamond products has become available commercially some of which are available as polycrystalline products. Crystalline diamonds preferentially fractures on (111), (110) and (100) planes whereas PCD tends to be isotropic and exhibits this same cleavage but on a microscale and therefore resists catastrophic large scale cleavage failure. The result is a retained sharpness which appears to resist polishing and aids in cutting. Such products are described, for example, in U.S. Pat. Nos. 3,913,280; 3,745,623; 3,816,085; 4,104,344 and 4,224,380.

In general, the PCD products are fabricated from synthetic and/or appropriately sized natural diamond crystals under heat and pressure and in the presence of a solvent/catalyst to form the polycrystalline structure. In one form of product, the polycrystalline structures includes distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being achieved by dissolving out the nondiamond material or at least a portion thereof, as disclosed for example, in U.S. Pat. Nos. 3,745,623; 4,104,344 and 4,224,380. For convenience, such a material may be described as a porous PCD, as referenced in U.S. Pat. No. 4,224,380.

Polycrystalline diamonds have been used in drilling products either as individual elements or as relatively thin PCD tables supported on a cemented tungsten carbide (WC) support backings. In one form, the PCD compact is supported on a cylindrical sling about 13.3 mm in diameter and about 3 mm long, with a PCD table of about 0.5 to 0.6 mm in cross section on the face of the cutter. In another version, a stud cutter, the PCD table also is supported by a cylindrical substrate of tungsten carbide of about 3 mm by 13.3 mm in diameter by 26 mm in overall length. These cylindrical PCD table faced cutters have been used in drilling products intended to be used in soft to medium-hard formations.

Individual PCD elements of various geometrical shapes have been used as substitutes for natural diamonds in certain applications on drilling products. However, certain problems arose with PCD elements used as individual pieces of a given carat size or weight. In general, natural diamond, available in a wide variety of shapes and grades, was placed in predefined locations in a mold, and production of the tool was completed by various conventional techniques. The result is the formation of a metal carbide matrix which holds the diamond in place, this matrix sometimes being referred to as a crown, the latter attached to a steel blank by a metallurgical and mechanical bond formed during the process of forming the metal matrix. Natural diamond is sufficiently thermally stable to withstand the heating process in metal matrix formation.

In this procedure above described, the natural diamond could be either surface-set in a predetermined orientation, or impregnated, i.e., diamond is distributed throughout the matrix in grit or fine particle form.

With early PCD elements, problems arose in the production of drilling products because PCD elements especially PCD tables on carbide backing tended to be thermally unstable at the temperature used in the furnacing of the metal matrix bit crown, resulting in catastrophic failure of the PCD elements if the same procedures as were used with natural diamonds were used with them. It was believed that the catastrophic failure was due to thermal stress cracks from the expansion of residual metal or metal alloy used as the sintering aid in the formation of the PCD element.

Brazing techniques were used to fix the cylindrical PCD table faced cutter into the matrix using temperature unstable PCD products. Brazing materials and procedures were used to assure that temperatures were not reached which would cause catastrophic failure of the PCD element during the manufacture of the drilling tool. The result was that sometimes the PCD components separated from the metal matrix, thus adversely affecting performance of the drilling tool.

With the advent of thermally stable PCD elements, typically porous PCD material, it was believed that such elements could be surface-set into the metal matrix much in the same fashion as natural diamonds, thus simplifying the manufacturing process of the drill tool, and providing better performance due to the fact that PCD elements were believed to have advantages of less tendency to polish, and lack of inherently weak cleavage planes as compared to natural diamond.

Significantly, the current literature relating to porous PCD compacts suggests that the element be surface-set. The porous PCD compacts, and those said to be temperature stable up to about 1200° C. are available in a variety of shapes, e.g., cylindrical and triangular. The triangular material typically is about 0.3 carats in weight, measures 4 mm on a side and is about 2.6 mm thick. It is suggested by the prior art that the triangular porous PCD conmpact be surface-set on the face with a minimal point exposure, i.e., less than 0.5 mm above the adjacent metal matrix face for rock drills. Larger one per carat synthetic triangular diamonds have also become available, measuring 6 mm on a side and 3.7 mm thick, but no recommendation has been made as to the degree of exposure for such a diamond. In the case of abrasive rock, it is suggested by the prior art that the triangular element be set completely below the metal matrix. For soft nonabrasive rock, it is suggested by the prior art that the triangular element be set in a radial orientation with the base at about the level of the metal matrix. The degree of exposure recommended thus depended on the type of rock formation to be cut.

The difficulties with such placements are several. The difficulties may be understood by considering the dynamics of the drilling operation. In the usual drilling operation, be it mining, coring, or oil well drilling, a fluid such as water, air or drilling mud is pumped through the center of the tool, radially outwardly across the tool face, radially around the outer surface (gage) and then back up the bore. The drilling fluid clears the tool face of cuttings and to some extent cools the cutter face. Where there is insufficient clearance between the formation cut and the bit body, the cuttings may not be cleared from the face, especially where the formation is soft or brittle. Thus, if the clearance between the cutting surface-formation interface and the tool body face is relatively small and if no provision is made for chip clearance, there may be bit clearing problems.

Other factors to be considered are the weight on the drill bit, normally the weight of the drill string and principally the weight of the drill collar, and the effect of the fluid which tends to lift the bit off the bottom. It has been reported, for example, that the pressure beneath a diamond bit may be as much as 1000 psi greater than the pressure above the bit, resulting in a hydraulic lift, and in some cases the hydraulic lift force exceeds 50% of the applied load while drilling.

One surprising observation made in drill bits having surface-set thermally stable PCD elements is that even after sufficient exposure of the cutting face has been achieved, by running the bit in the hole and after a fraction of the surface of the metal matrix was abraded away, the rate of penetration often decreases. Examination of the bit indicates unexpected polishing of the PCD elements. Usually ROP can be increased by adding weight to the drill string or replacing the bit. Adding weight to the drill string is generally objectionable because it increases stress and wear on the drll rig. Further, tripping or replacing the bit is expensive since the economics of drilling in normal cases are expressed in cost per foot of penetration. The cost calculation takes into account the bit cost plus the rig cost including trip time and drilling time divided by the footage drilled.

Clearly, it is desirable to provide a drilling tool having thermally stable PCD elements and which can be manufactured at reasonable costs and which will perform well in terms of length of bit life and rate of penetration.

It is also desirable to provide a drilling tool having thermally stable PCD elements so located and positioned in the face of the tool as to provide cutting without a long run-in period, and one which provides a sufficient clearance between the cutting elements and the formation for effective flow of drilling fluid and for clearance of cuttings.

Run-in in PCD diamond bits is required to break off the tip or point of the triangular cutter before efficient cutting can begin. The amount of tip loss is approximately equal to the total exposure of natural diamonds. Therefore, an extremely large initial exposure is required for synthetic diamonds as compared to natural diamonds. Therefore, to accommodate expected wearing during drilling, to allow for tip removal during run-in, and to provide flow clearance necessary, substantial initial clearance is needed.

Still another advantage is the provision of a drilling tool in which thermally stable PCD elements of a defined predetermined geometry are so positioned and supported in a metal matrix as to be effectively locked into the matrix in order to provide reasonably long life of the tooling by preventing loss of PCD elements other than by normal wear.

It is also desirable to provide a drilling tool having thermally stable PCD elements so affixed in the tool that it is usable in specific formations without the necessity of significantly increased drill string weight, bit torque, or significant increases in drilling fluid flow or pressure, and which will drill at a higher ROP than conventional bits under the same drilling conditions.

BRIEF SUMMARY OF THE INVENTION

The present invention is an improvement in a rotating bit having a plurality of teeth wherein each tooth includes a polycrystalline diamond cutting element. Each tooth disposed on the face of the rotating bit comprises a teardrop shaped projection including a PCD element made of matrix material of the rotating bit. The matrix material of the tooth is integrally formed with the matrix material of the rotating bit itself. The tooth is particularly characterised in shape by an oval shaped base rising from the face of the rotating bit and forming a raised collar around the tooth. The tooth integrally extends from the oval shaped base to form a prepad which has a generally circular conical segment shape which is contiguous to the PCD element disposed in the tooth. The prepad also has a trailing face which is substantially congruous with the leading face of the PCD element. The tooth further includes a trailing support integrally formed with the oval shaped base and rising therefrom. The trailing support is contiguous with a trailing face of the PCD element and is substantially congruous therewith. The trailing support tapers from the trailing face of the PCD element to a point on the bit face whereby the tooth forms as a whole a teardrop shaped projection from the bit face. The body of the teardrop shape is surrounded by the oval shaped base whereby the matrix material of the rotating bit is disposed around and on each lateral side of the PCD element on a lower portion of the element thereby securing the element to the rotating bit face without substantially increasing the amount of matrix material above the rotating bit face.

Consider now the drawings described below wherein like elements are referenced by like numerals.

BRIEF DESCRIPTION OF THE DRAWINGS

FIG. 1 is a longitudinal sectional view of a tooth including a radially set diamond element improved according to the present invention.

FIG. 2 is a plan view of the tooth shown in FIG. 1.

FIG. 3 is a cross-sectional view taken through line 3—3 of FIG. 1.

FIG. 4 is a cross-sectional view of a rotating bit showing a second embodiment of a tooth including a tangentially set diamond element improved according to the present invention taken through line 4—4 of FIG. 5.

FIG. 5 is a plan view of the tooth illustrated in FIG. 4.

FIG. 6 is a cross-sectional view taken through line 6—6 of FIG. 5.

Figure 7:
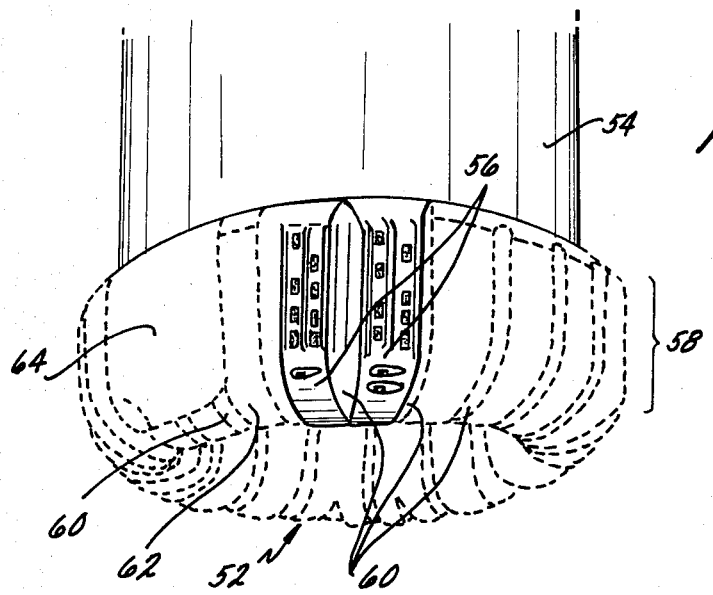
FIG. 7 is a pictorial perspective of a coring bit incorporating teeth of the present invention.

The present invention and its various embodiments may be better understood by viewing the above Figures in light of the following description.

DETAILED DESCRIPTION OF THE PREFERRED EMBODIMENTS

The present invention is an improvement in diamond tooth design in a rotating bit. The useful life of a diamond rotating bit can be extended by using a tooth design which retains the diamond cutting element on the face of the rotating cutting bit for a longer period and which maximizes the useful life of the diamond cutting element by avoiding loss and premature damage or fracture to the diamond cutting element.

To extend the useful life of the diamond cutting element, the triangular, prismatic shaped synthetic polycrystalline diamonds are exposed to the maximum extent from the bit face of the rotating drill. However, the farther such diamonds are exposed from the bit face, the less they are embedded and secured within the bit face. Although the degree of security and retention of such a diamond cutting element can be increased by providing an integral extension of the diamond face in the form of a prepad and trailing support, the present invention has further improved the security of retention by forming a generally oval shaped collar about the base of a teardrop-shaped cutting tooth having in one embodiment a bulbous prepad in front of the leading face of the diamond cutting element and about at least a portion of the trailing support forming the tail of an otherwise teardrop-shaped tooth. Thus, the tooth in plan view as described below takes the form and appearance of a teardrop-shaped tooth having a generally ovulate collar extending about the midsection of the tooth. This allows the diamond to be exposed to the maximum extent while providing additional integral matrix material to secure the diamond to the rotating bit face while using a minimum of such matrix material projecting from the bit face.

The present invention can be better understood by considering the above general description in the context of the Figures.

Referring now to FIG. 1, a longitudinal section of a tooth generally denoted by reference number 10 is illustrated as taken through line 1—1 of FIG. 2. Tooth 10 is particularly characterised by a polycrystalline diamond cutting element 14 in combination with matrix material integrally extending from rotating bit face 12 to form a prepad 16 and trailing support 18. However, tooth 10 of FIG. 1 differs from that described in the above denoted application by the addition of an integrally formed, ovulate shaped collar 20 extending from bit face 12 by a height of 22.

FIG. 1 also shows in dotted outline a second and smaller similarly triangular prismatic shaped diamond element 28 which has the same substantial shape as element 14 but can be included within tooth 10 as an alternative substitute cutting element of smaller dimension. Specifically, diamond 28 is a conventionally manufactured polycrystalline diamond stone manufactured by General Electric Company under trademark Geoset 2102, while larger cutting element 14 is a similarly shaped but larger polycrystalline diamond stone manufactured by General Electric Company under the trademark Geoset 2103. The Geoset 2102 measures 4.0 mm on a side and is 2.6 mm thick, while the Geoset 2103 measures 6.0 mm on a side and is 3.7 mm thick. Thus, the same tooth 10 may accommodate alternately either diamond cutting element while having a similar exposure profile above bit face 12. In the case of smaller diamond element 28, trailing support 18 is integrally continued through portion 30 to provide additional trailing support to the smaller diamond element 28, which portion 30 is deleted and replaced by larger diamond element 14 in the alternative embodiment when the larger diamond is used. In either case, at least 2.7 mm of element 14(28) is exposed above bit face 12.

As better seen in plan outline in FIG. 2, tooth 10 has a main body portion principally characterized by a generally triangular prismatic shaped polycrystalline diamond element 14 (28). Element 14 (28) is tangentially set within tooth 10 which is defined to mean that apical edge 24 of element 14 (28) is generally aligned with the normal direction of movement of tooth 10 during a cutting or drilling operation, namely the general direction of travel of tooth 10 as illustrated in FIG. 2, as defined by bit rotation, is from right to left approximately parallel to the line denoted by arrow 31. The apical edge 24 of diamond element 14 (28) is illustrated in solid outline while a portion of its sides 25 and base 26 is shown in dotted outline in FIG. 1 and dotted and solid outline in FIG. 2. Generally oval-shaped collar 20 completely circumscribes the main body of tooth 10 and in particular, diamond element 14 (28). As better shown in longitudinal sectional view in FIG. 1 and in perpendicular sectional view in FIG. 3 taken through line 3—3 of FIG. 1, collar 20 extends from bit face 12 by a preselected height 22 to provide additional integrally formed matrix material. The matrix material is integrally formed with bit face 10 by conventional metallic powder metallurgical techniques to more firmly embed diamond element 14 (28) within bit face 12. However, a maximal amount of diamond element 14 (28) has been extended above bit face 12 leaving substantial portions of element 14 (28) uncovered by any matrix material as best illustrated in FIG. 3. However, with the addition of a minimal amount of integrally formed matrix material, collar 20 provides additional lateral, forward and rearward support to element 14 (28) to secure element 14 (28) to bit face 12. Bit face 12 may in fact be the surface of the crown or face of a bit which forms the main bit body, or may be construed as the body of a pad or raised land on the crown. Bit face 12 is thus to be generally understood as any basal surface on which tooth 10 is disposed.

Thus, tooth 10 as shown in FIG. 2 forms a singular geometric shape generally described as a teardrop-shaped tooth having a generally oval-shaped collar disposed around the triangular prismatic shaped diamond element.

FIG. 5 is a plan view of a second embodiment of the present invention wherein a diamond cutting element 32 of the same general type as that described in connection with the embodiment of FIGS. 1–3 is tangentially set within the tooth, which tooth is generally denoted by reference numeral 34. For the purpose of simplicity, only one size diamond element 32 is shown in the embodiment of FIGS. 4–6. However, it must be expressly understood that various sizes of elements may be incorporated within the tangentially set design of the embodiment of FIGS. 4–6, according to the teachings as exemplified in connection with FIGS. 1–3. The tangentially set of element 32 is defined as the disposition of element 32 within tooth 34 such that a side surface 36 is presented as the leading surface in the direction of normal travel of tooth 34, as defined by the bit rotation, as denoted by arrow 38 in FIG. 5.

Turning again to FIG. 4, which is a cross-sectional view taken through line 4—4 of FIG. 5, tooth 34 includes a prepad 40 which has a trailing surface substantially congruous and contiguous with leading surface 36 of diamond element 32 and is integrally formed with the matrix material of bit face 42. Again, bit face 42 is taken as the basal surface upon which tooth 34 is disposed and includes, but is not limited to, the surface of the crown of a drilling bit, or a pad or raised land on the drilling bit. Element 32 is reinforced or supported by a trailing support 44. The tooth design of the second embodiment is particularly characterized by a generally ovulate collar 46, best illustrated in plan view in FIG. 5 which substantially surrounds or circumscribes diamond element 32. Thus, although tangential support in the direction of arrow 38 is substantially provided by prepad 40 and trailing support 44, collar 46 provides lateral support on both sides of diamond element 32, thereby securely embedding and fixing element 32 within the matrix material integrally forming tooth 34 and extending above bit face 42.

Turning now to FIG. 6, a cross-sectional view taken through line 6—6 of FIG. 5 as illustrated shows the substantially increased cutting surface 36 presented in the direction of movement 38 by a tangentially set element 32 as compared to a radially set element of the same shape shown in FIG. 3. Although element 32 has been illustrated with leading face 36 shown substantially perpendicular to the plane of bit face 42 and is thus shown as a substantially full, rectangular plane in FIG. 6, it must be understood that the orientation of PCD element 32 within tooth 34 may be either angled forwardly or rearwardly from that shown in FIG. 4 to provide a leading surface 36 which is characterised by either a forward or rearward rake according to design choice.

In addition, prepad 40 is illustrated in FIGS. 4 and 5 as a half segment of a right circular cylinder. It is entirely within the scope of the present invention that prepad 40 may be sloped in the form as suggested by prepad 16 shown in respect to the first embodiment of FIGS. 1–3 and thus be formed from a half segment of a right circular cone. In addition, both prepads 16 and 40 may extend only partially up the leading surface of the contiguous and corresponding diamond cutting element to expose, in whole or part, the corresponding leading surface of the diamond cutting element. It is further within the scope of the invention that prepad 40 or 16 may be substantially or entirely eliminated leaving collar 46 and 20 respectively in place and contiguous with its corresponding diamond cutting element. Further, although trailing support 44 of the embodiment of FIGS. 4–6 has been shown as a platformed ramp leading to a rounded end 48, best seen in FIG. 5, other outlines could also be used for tapering trailing support 44. For example, instead of beginning the taper at edge 50 as shown in illustrated embodiment, the taper could begin at the leading edge of PCD element 32 to form a single surface ramp to end 48. Similarly, trailing support 44 could be tapered to a point on bit face 42 in a manner similar to the embodiment best shown in plan view in FIG. 2 instead of having the rounded trailing edge 48 as depicted in the plan view of FIG. 5.

FIG. 7 is a pictorial perspective of teeth improved according to the present invention as seen in a coring bit, generally denoted by reference numeral 52. The coring bit 52 includes a shank 54 having a plurality of pads 56 radially disposed over the nose, flank and shoulder of coring bit 52 and continued longitudinally along gage 58 in the conventional manner. Pads 56 are each separated by channels 60 which serve as the water courses and collectors according to conventional design. In the illustrated embodiment, coring bit 52 includes a single row of teeth 62 on each pad 56. The diamond cutting element within each tooth 62 is disposed at or near the edge of the pad adjacent to channel 60 with the trailing support of each tooth 62 aligned in generally tangential direction as defined by the rotation of bit 52. Thus, a maximal amount of the diamond cutting element is exposed and presented for useful cutting action while a minimum of the matrix material, usually hardened tungsten carbide, serves to secure the diamond cutting element to the bit face while minimizing the amount of matrix material which must be worn away or which otherwise could interfer with the direct cutting action of the diamond element.

Figure 8:
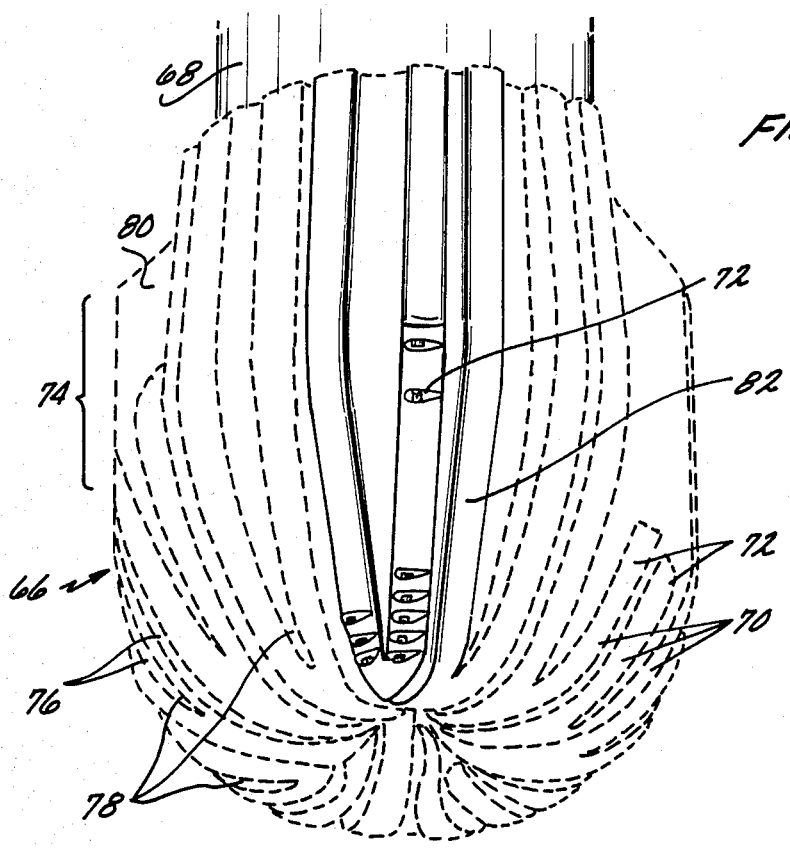
FIG. 8 is a pictorial perspective of a petroleum bit incorporating teeth of the present invention.

FIG. 8 is a pictorial perspective of a petroleum bit also incorporating teeth designed according to the present invention. Petroleum bit 66 is similarly designed to include a conventional shank 68 and a plurality of pads 70 upon which teeth 72 are disposed. Again, teeth 72 are formed in a single row, although other rows and multiple patterns could be provided. In the particular design illustrated in connection with FIG. 8, pads 70 extend from gage 74 longitudinally across the bit face and are paired at the nose and apex of bit 66 with an adjacent pad. The pads then merge to form a single pad extending to the apex and center of bit 66. Where pads 70 merge a single pad is formed continuing to the bit center with a double row of teeth. As before, pads 70 are defined and separated from each other by an alternating series of conventional waterways 76 which communicate with conventional nozzles (not shown) provided in the center of bit 66 and adjacent collectors 78 originating at the point of merger of the paired pads 70. Bit 66 also includes conventional junk slots 80 defined in gage 74 as is well known to the art.

As before, teeth 72 on bit 66 are integrally formed using conventional powder metallurgical techniques with the matrix material of pads 70 extending above surface 82 of the corresponding pad 70. The trailing support of each tooth 72 is aligned in the generally tangential direction as defined by the rotation of bit 66 with the diamond cutting element of tooth 72 placed at or near the leading edge of the corresponding pad 70 as defined by the adjacent waterway 76 or collector 78 as the case may be.

Many modifications and alterations may be made by those having ordinary skill in the art without departing from the spirit and scope of the present invention. For example, although the teeth of the present invention have been shown in rotating bits, typically rotary bits, it must be understood that such diamond bearing teeth can also be used in many other applications wherever it is beneficial to securely retain a diamond cutting element on the surface of a cutting or grinding tool. The particular illustrated embodiment has been shown as using generally triangular and prismatic diamond cutting elements, but must be understood that other geometrical shapes could be adapted to the generalized tooth design of the present invention without departing from the scope of the claims. Therefore, the illustrated embodiment has only been shown for purposes of clarification and example, and should not be taken as limiting the invention as defined in the following claims.

I claim:

1. A rotatable bit for use in earth boring comprising:

a matrix body member having portions forming a gage and a face, said face including a plurality of waterways forming pad means between adjacent waterways, each said pad means including a plurality of spaced synthetic polycrystalline diamond cutting elements mounted directly in the matrix during matrix formation, each of said cutting elements being of a predetermined geometric shape with a cutting face and being temperature stable to at least about 1200° C., the said cutting elements including a portion received within the body matrix of said pad means and a portion which extends above the surface of said pad means and which is adapted to form the cutting face of said cutting element, matrix material extending above said pad means and forming a plurality of spaced teeth, at least some of said cutting elements being positioned in said teeth, at least some of said teeth including a trailing support contacting the rear of the associated cuttting element, at least some of said teeth which include a trailing support also including a prepad of matrix material extending above said pad means and contacting and fully covering said cutting face of at least some of the associated cutting elements, the length of said tooth to the rear of said cutting element being greater than the length of said prepad, said cutting elements including side surfaces, at least a portion of the side surfaces of at least some of said cutting elements being above the pad and being at least partially exposed, and the portion of each said cutting elements which forms the cutting face of said cutting elements extending more than 0.5 mm above the surface of the corresponding pad.

2. A rotatable bit as set forth in claim 1, wherein said cutting element is a porous synthetic polycrystalline diamond.

3. A rotatable bit as set forth in claim 1, wherein at least some of said teeth include collar means on at least the sides thereof, said collar means contacting at least a portion of the side surfaces of at least some of said cutting elements.

4. A rotatable bit as set forth in claim 3, wherein said collar means extends from the front of said prepad and along the side of said tooth and towards the rear of said cutting element.

5. A rotatable bit as set forth in claim 1, wherein said bit is a core bit.

6. A rotatable bit as set forth in claim 1, wherein at least some of said cutting elements are positioned such that the prepad is at the junction of said pad and waterway.

7. A rotatable bit as set forth in claim 1, wherein said cutting element is triangular in shape and includes front, side, rear and base faces, and wherein said side faces form an apex which is fully exposed and which constitutes a top surface of said cutting element.

8. A rotatable bit as set forth in claim 7, wherein said base face is received within the body of said matrix and said side faces and engaged by collar means which form part of the tooth.

9. A rotatable bit as set forth in claim 7, wherein each said apex is oriented radially with respect to said tooth.

10. A rotatable bit as set forth in claim 7 wherein said apex is oriented tangentially with respect to said tooth.

11. A rotatable bit for use in earth boring comprising:

a matrix body member having portions forming a gage and a face, said face including a plurality of waterways forming pad means between adjacent waterways, each said pad means including a plurality of spaced synthetic polycrystalline diamond cutting elements mounted directly in the matrix during matrix formation, each of said cutting elements being of a predetermined geometric shape and being temperature stable to at least about 1200° C., the said cutting elements including a portion received within the body matrix of said pad means and a front portion and side faces which extend above the surface of said pad means, said front portion forming the cutting face of said cutting element, matrix material extending above said pad means and forming a plurality of spaced teeth each of which includes a forward prepad portion, and a trailing support generally to the rear of the side faces andd the front portion of said cutting element, at least a portion of said side faces being exposed along the side of said associated tooth, said trailing support for each said tooth being greater in length than the width of said tooth and the length of said prepad, said prepad contacting and covering at least a portion of the cutting face of at least some of said cutting elements, and the portion of each of said elements which forms the cutting face extending more than 0.5 mm above the surface of the corresponding pad.

12. A rotatable bit for use in earth boring comprising:

a matrix body member having portions forming a gage and a face, a plurality of spaced synthetic polycrystalline diamond cutting elements mounted in the matrix of said face of said matrix body member, said face including a plurality of waterways, each of said cutting elements being of a predetermined geometric shape and being temperature stable to at least about 1200° C., each of said cutting elements having a front cutting face, side faces and a rear portion, all of which faces and rear portion extend above said matrix body member, and each of said cutting elements including a portion received within said matrix body member, at least some of said cutting elements on said face being mounted in a tooth, a plurality of which are on said face and formed of matrix material to receive at least some of said cutting elements, at least some of said teeth including a trailing support contacting the entire rear portion of said cutting elements and prepad means which contacts the said cutting elements and fully covers the cutting face, said trailing support having a length at least equal to the length of said prepad, and the front and side surfaces and said rear portion of said cutting elements extending more than 0.5 mm above the face of said matrix in which they are mounted.

13. A rotatable bit for use in earth boring comprising:

a matrix body member having portions forming a gage and a bit face, a plurality of spaced synthetic polycrystalline diamond cutting elements mounted directly in said matrix of said bit during matrix formation of said body member, each of said cutting elements being of a predetermined geometric shape and having a front face adapted to form the cutting face and side and rear faces, and being temperature stable to at least about 1200° C., the said cutting elements being supported in a tooth, a plurality of which are provided on said bit face to support a plurality of cutting elements, said front, side and rear faces of said cutting elements extending above the matrix of the bit face in which they are mounted, each tooth including a body of matrix material which covers the front face and all of the rear face while at least a portion of the side faces are exposed, and at least the front face of said cutting element which is adapted to form said cutting face extending more than 0.5 mm above the matrix of the bit face in which they are mounted.

14. A rotatable bit as set forth in any one of claims 1–6 or 11–13 wherein said cutting elements is triangular in shape and includes a front face, adjacent side faces, a base face and a rear face, and at least a portion of said base face being received in said body matrix and said front face being adapted to form the cutting face of said cutting element.

15. A rotatable bit as set forth in any one of claims 4–7 or 11–13, wherein said tooth includes collar means which contacts at least a portion of the side faces of said cutting elements.

* * * * *